US006322145B1

(12) United States Patent
Melgarejo et al.

(10) Patent No.: US 6,322,145 B1
(45) Date of Patent: Nov. 27, 2001

(54) WHEELCHAIR SEAT BACK WITH ADJUSTABLE TILT

(75) Inventors: Mauricio Melgarejo; Alejandro Melgarejo, both of Simi Valley, CA (US)

(73) Assignee: Freedom Designs, Inc., Simi Valley, CA (US)

( * ) Notice: Subject to any disclaimer, the term of this patent is extended or adjusted under 35 U.S.C. 154(b) by 0 days.

(21) Appl. No.: 09/561,611

(22) Filed: Apr. 27, 2000

Related U.S. Application Data

(60) Provisional application No. 60/131,310, filed on Apr. 27, 1999.

(51) Int. Cl.[7] ..... A47C 1/024

(52) U.S. Cl. ..... 297/354.11; 297/354.12; 16/374; 16/375

(58) Field of Search ..... 297/354.11, 354.12, 297/354.1; 16/82, 374, 375

(56) References Cited

U.S. PATENT DOCUMENTS

| | | | | |
|---|---|---|---|---|
| Re. 8,131 | | 3/1878 | Ross . | |
| 59,457 | | 11/1866 | Ross . | |
| D. 180,188 | | 4/1957 | Herider . | |
| 439,403 | | 10/1890 | Houghton . | |
| 2,165,526 | | 7/1939 | Barie . | |
| 2,304,349 | * | 12/1942 | Fox | 297/354.11 X |
| 2,762,422 | | 9/1956 | Stratton . | |
| 3,712,671 | | 1/1973 | Dalton et al. . | |
| 4,234,228 | | 11/1980 | Flamm . | |
| 4,333,681 | | 6/1982 | Nelson . | |
| 4,430,771 | * | 2/1984 | Salice | 16/374 X |
| 4,544,200 | | 10/1985 | Dunn et al. . | |
| 4,655,471 | | 4/1987 | Peek . | |
| 4,738,487 | | 4/1988 | Shalinksy et al. . | |
| 4,759,561 | | 7/1988 | Janssen . | |
| 4,957,302 | | 9/1990 | Maxwell . | |
| 5,020,816 | | 6/1991 | Mulholland . | |
| 5,181,762 | | 1/1993 | Beumer . | |
| 5,195,803 | | 3/1993 | Quintile . | |
| 5,240,265 | | 8/1993 | Huang . | |
| 5,297,021 | | 3/1994 | Koerlin et al. . | |
| 5,445,433 | | 8/1995 | Avihod . | |
| 5,549,357 | | 8/1996 | Counts et al. . | |
| 5,785,384 | | 7/1998 | Sagstuen . | |
| 5,865,504 | | 2/1999 | Warhaftig . | |
| 5,904,398 | | 5/1999 | Farricielli . | |
| 6,038,737 | * | 3/2000 | Boright | 16/374 X |

* cited by examiner

*Primary Examiner*—Peter R. Brown

(57) ABSTRACT

Broadly defined, the present invention is a wheelchair seat in which the back of the seat can recline relative to the bottom of the seat. In one particular embodiment, the angle of the back of the seat relative to the bottom portion of the seat can be adjusted at any angle within a particular range of angles. The wheelchair seat can have a locking mechanism that the user can engage to fix the relative angle between the bottom seat portion and the back seat portion into place once the angle is adjusted as desired.

11 Claims, 4 Drawing Sheets

WHEELCHAIR SEAT BACK WITH ADJUSTABLE TILT

This application claims benefit of provisional application serial No. 60/131,310 filed Apr. 27, 1999.

BACKGROUND OF THE INVENTION a. Field of the Invention

The present invention relates to wheelchair seats and, in particular, to a wheelchair seat with a back that can be tilted relative to the bottom of the seat.

b. Prior Art

A typical wheelchair seat has a bottom portion on which the patient sits, and a back portion against which the patient's back rests. The back and bottom portions are typically fixed at a particular angle relative to one another. Wheelchair designs exist that permit the back and bottom portions to be reclined together, without changing the relative angle between the two. That is, when the back portion is rotated backwardly, the bottom portion rotates upwardly.

In some situations such as particular therapies, however, it is preferable to recline the patient's back without changing the angle of the seat bottom. U.S. Pat. No. 4,333,681 to Nelson discloses a wheelchair with a seat back that is controlled with an electric ram. The electric ram has a rod that extends and contracts to recline the wheelchair seat back. The Nelson arrangement requires an electric power source to operate.

U.S. Pat. No. 3,712,671 to Dalton discloses a wheelchair seat back that is pivotally mounted to a hinge pin. The seat back travels along a support, and the seat back may be locked into place along the support by tightening a wing nut. The support extends a substantial distance behind the seat back, and physically extends into the space that the person pushing the wheelchair is likely to occupy.

U.S. Pat. No. 2,165,529 discloses a wheelchair with an adjustable back to which is attached an adjustable ratchet bar. The ratchet bar has a number of detents that are engageable with a stop. The seat back can be reclined backwardly, and the position fixed in place by engaging a detent with the stop. The detents are jagged, however, and present a rough surface onto which the user's clothing can catch.

SUMMARY OF THE INVENTION

It is desirable to provide a wheelchair having a back with a position that can be easily adjusted and firmly secured into place. It is also desirable that the adjustment mechanism have a low profile and does not interfere with the person pushing the wheelchair or with the person riding in the wheelchair.

Broadly defined, the present invention is a wheelchair seat in which the back of the seat can recline relative to the bottom of the seat. In one particular embodiment, the angle of the back of the seat relative to the bottom portion of the seat can be adjusted at any angle within a particular range of angles. The wheelchair seat can have a locking mechanism for the user to engage in order to fix the relative angle between the bottom seat portion and the back seat portion into place once the angle is adjusted as desired.

One embodiment of the invention is a method for adjusting the angle of a wheelchair seat, comprising the steps of (a) providing a system for adjusting the angular position of the backrest of a wheelchair seat, the wheelchair seat having a bottom seat portion and a back seat portion, the system comprising a hinge having a first hinge bracket fixedly mounted to the bottom seat portion and a moving hinge bracket fixedly mounted to the back seat portion, the first hinge bracket being hingedly connected with the second hinge bracket, an adjustment bolt having a head with an aperture, the adjustment bolt extending through the first hinge bracket, a threaded block hingedly mounted on the moving bracket, the adjustment bolt being engaged with the threaded block, and an adjustment tool comprising a handle and a prong, the prong having a head with a shape that is compatible with the aperture in the adjustment bolt. The method also includes the step of inserting the head of the prong of the adjustment tool into the aperture of the adjustment bolt, and rotating the adjustment tool to rotate the adjustment bolt, causing the moving member of the hinge to rotate and the back of the wheelchair seat to change angle relative to the bottom member of the seat.

In particular embodiments of the method, the prong has a hexagonal profile and the head aperture has a hexagonal profile. The adjustment bolt may also have a head, with the system further comprising an adjustment nut threadedly mounted to the bolt, in between the bolt head and the first hinge piece. The moving hinge piece may have left and right side slots, and the threaded block is hingedly mounted to the moving hinge piece with a pin, the pin extending from the left to the right slot.

The method may further comprise the step of securing the angle of the hinge by tightening the adjustment nut against the first bracket. The system may further comprise a bracket, the bracket being fixedly mounted to the seat bottom, and the first hinge piece being mounted to the bracket, thereby fixedly mounting the first hinge piece to the seat bottom.

Another embodiment of the invention is a system for adjusting the angular position of the backrest of a wheelchair seat, the wheelchair seat having a bottom seat portion and a back seat portion, the system comprising a hinge having a first hinge bracket fixedly mounted to the bottom seat portion and a moving hinge bracket fixedly mounted to the back seat portion, said first hinge bracket being hingedly connected with said second hinge bracket. The system also includes an adjustment bolt having a head with an aperture, said adjustment bolt extending through said first hinge bracket. A threaded block is hingedly mounted on the moving bracket, said adjustment bolt being engaged with said threaded block. The system also includes a tool comprising a handle and a prong, said prong having a head with a shape that is compatible with said aperture in said adjustment bolt.

Various other objects and features of the invention will become apparent in the Detailed Description below, in the drawings and in the claims.

DETAILED DESCRIPTION OF A PREFERRED EMBODIMENT

Figure 1:
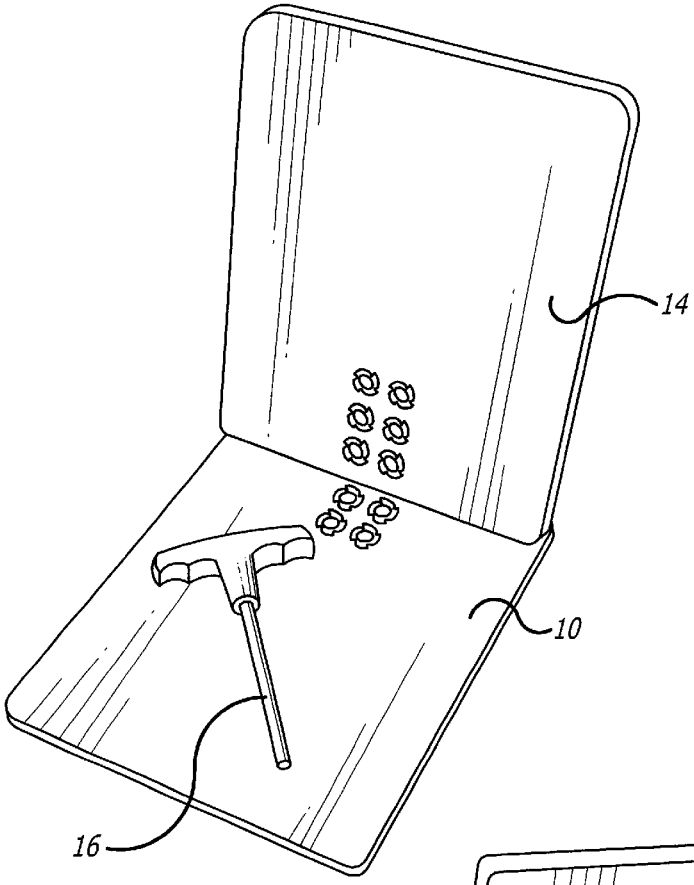
FIG. 1 is a front perspective view of a mock-up wheelchair seat illustrating the rear seat portion, the bottom seat portion, and an angle adjustment tool.

FIG. 1 shows a mock-up of a wheelchair seat 10. There is a bottom portion 12 on which the patient sits, and a back portion 14 against which the patient's back rests. As will be explained in more detail, the angle of the back portion can be adjusted relative to the bottom seat portion. In FIG. 1, an angle adjustment tool 16 rests on the bottom seat portion. The tool has a handle portion and an elongated prong. The user will use this tool to adjust the angle of the back seat portion 14 relative to the bottom seat portion 12.

Figure 2:
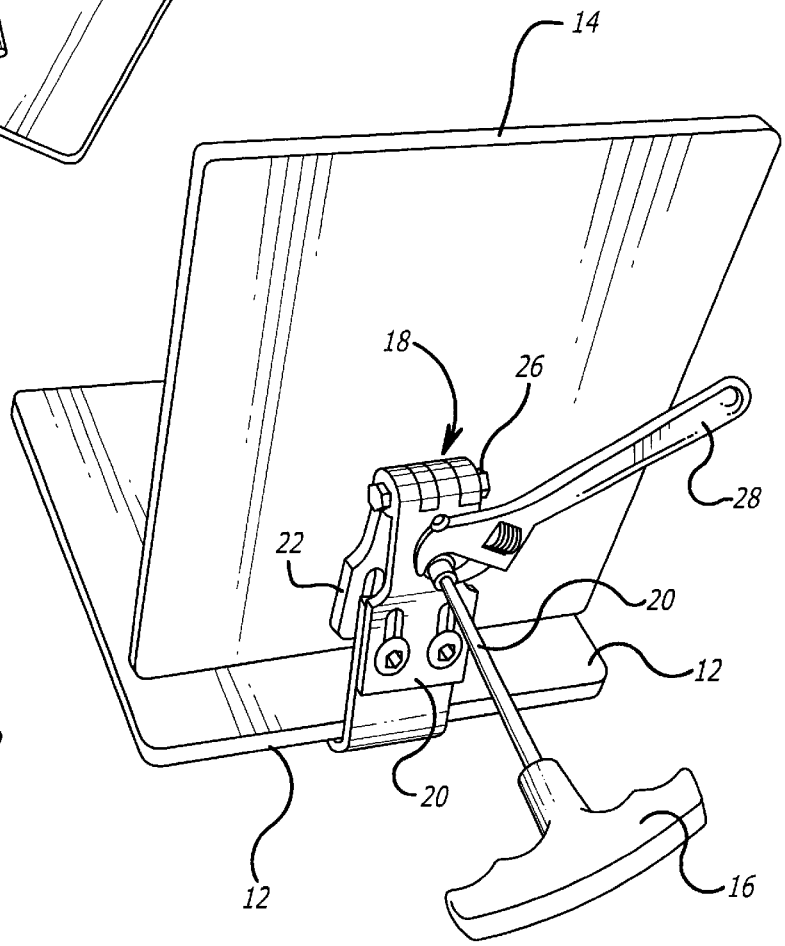
FIG. 2 is a rear perspective view of the mock-up of FIG. 1, illustrating one embodiment of an angle adjustment apparatus, the adjustment tool engaged in the angle adjustment apparatus, and a wrench that is later used to tighten the securing nut to secure the angle in place.
Figure 3:
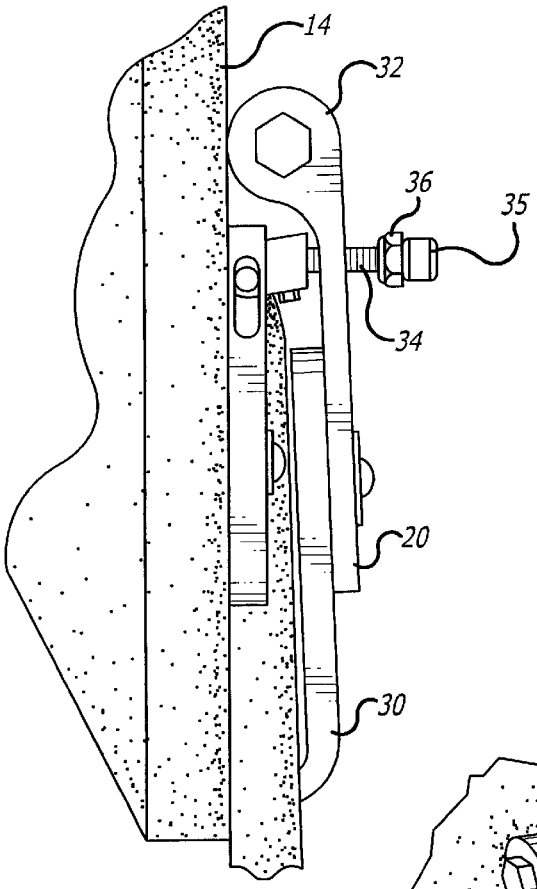
FIG. 3 is a bottom perspective view from underneath the bottom seat portion, showing the bottom bracket of the angle adjustment apparatus bolted onto the bottom seat portion.

FIG. 2 illustrates the rear of the mock-up wheelchair seat. An angle adjustment mechanism 18 has a hinged upper portion 20, with the back seat-securing bracket 22, a stationary bracket 24, and a hinge 26 between the two. FIG. 2 also illustrates the tools that are used to adjust the angle of the back portion of the seat: the angle adjustment tool 16 and a crescent wrench 28. FIG. 3 shows the various components shown in FIG. 2 and, in particular, shows how the lower bracket 30 is bolted onto the bottom of the bottom seat portion 12.

Figure 4:
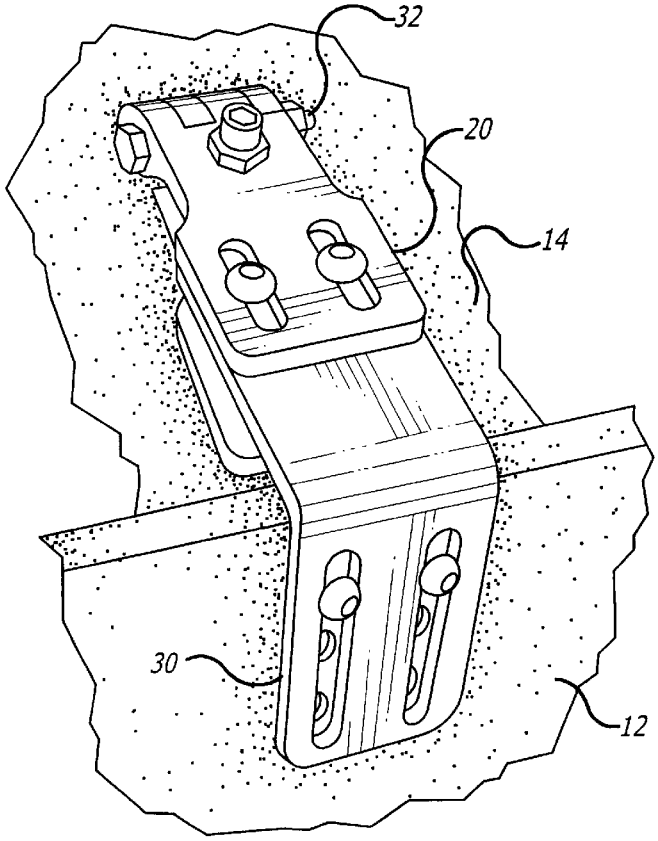
FIG. 4 is a side profile of the angle adjustment apparatus when the back seat portion is in an upright position.
Figure 6:
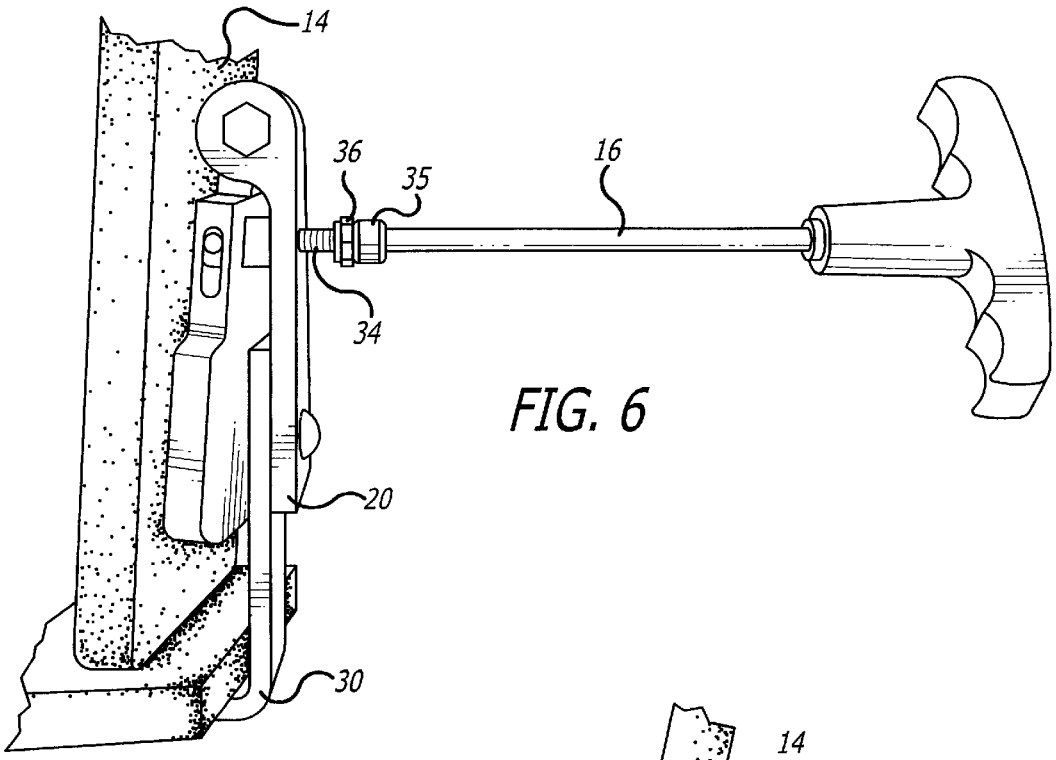
FIG. 6 illustrates the angle adjustment tool engaged in the adjustment head to recline the back portion of the seat.
Figure 7:
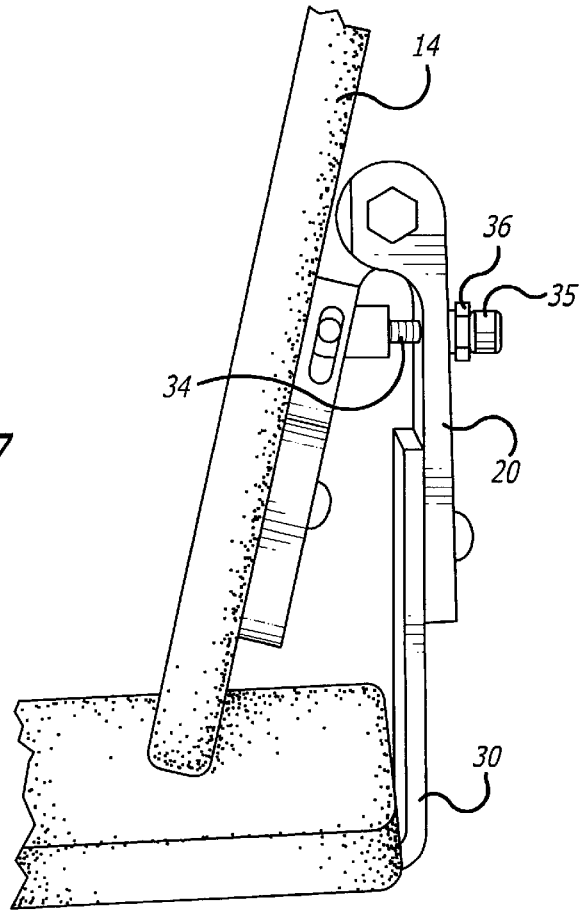
FIG. 7 illustrates the back seat portion having been reclined into a reclined position.

FIG. 4 illustrates various components of the upper portion of the hinge mechanism. The stationary upper portion 20 of the mechanism bolts onto the lower bracket 30. A hinge bolt 32 interconnects the back seat-securing bracket with the stationary upper portion 20 of the hinge mechanism. The mechanism also has an adjustment bolt 34, which the user rotates to adjust the angle of the back 14 of the seat, as illustrated in FIG. 6. Rotating the handle of the angle adjustment tool 16 causes the angle adjustment bolt 34, which has an engagement head 35, to turn, thereby rotating the portion of the back seat portion that is below the hinge bolt 32 forward, and generally causing the back seat portion to rotate about the hinge pin.

Figure 5:
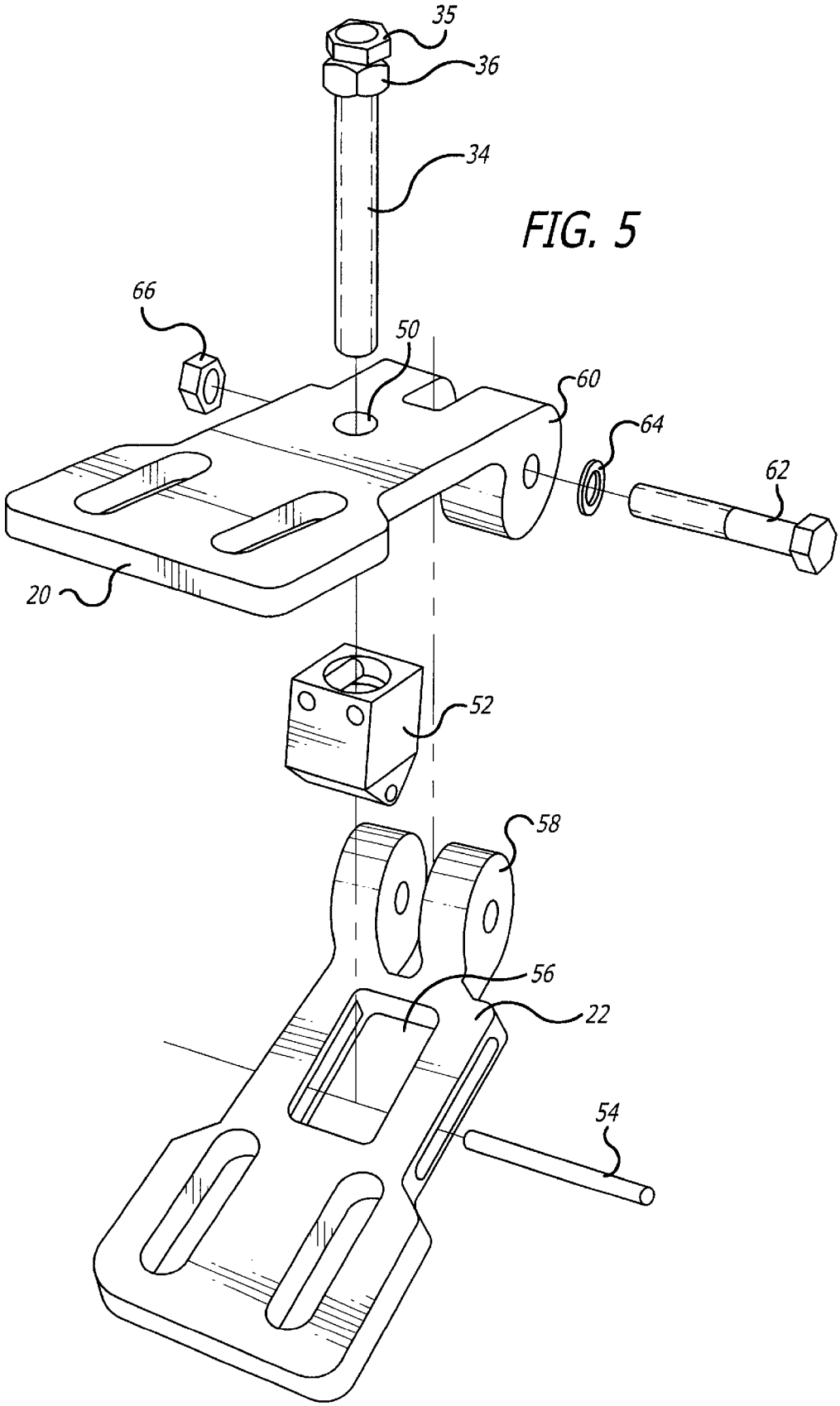
FIG. 5 is an exploded view of the components that make up the hinge.

FIG. 5 is an exploded view of the components of the preferred embodiment of the hinge mechanism. The adjustment bolt 34 has a bolt head 35, and an adjustment nut 36 is secured on the threads of the adjustment bolt. The bolt extends through a threaded aperture 50 in the stationary upper portion 20 of the hinge, and into a threaded block 52. The threaded block 52 is secured by a pin 54 into an opening 56 of the seat-securing bracket 22. The stationary upper portion 20 and the seat-securing bracket 22 each have respective interlocking apertured hinge portions 58 and 60. The interlocking hinge portions 58 and 60 are secured together with a bolt 62 that has a washer 64 and which is secured by a nut 66.

The adjustment bolt 34 threads into the threaded block 52, which has a threaded aperture to receive the bolt. The threaded aperature is typically provided on a cylindrical rotating piece (not shown) housed within the threaded block, such that the rotating piece generally rotates when the adjustment bolt is rotated. In this way, when the user rotates the adjustment bolt clockwise, the bolt extends forward toward portion 22 in proportion to the rotation of the bolt. Portion 22 is then pushed forward, and rotates about bolt 26. The adjustment bolt 34 does not disengage with the threaded block 52, as the cylindrical rotating piece within the block prevents the bolt from disengaging.

Returning to FIG. 2, once the angle adjustment bolt 34 has been rotated and the back seat portion 20 reclined, the securing nut 36 can be tightened down to secure the angle of the back seat portion in place. FIG. 2 illustrates a crescent wrench 28 being used to tighten the securing nut 36, although any other known nut-tightening device can be used. The securing nut can alternatively be a wing nut, such that a user can tighten it with his or her fingers.

To change the position of the hinge from the fully upright position to an angled position, the inserts the head of the tool 16 into the head 35 of the adjustment bolt 34. The head of the adjustment bolt 34 can have a hex profile, a square profile, or other standard profile, so long as it is compatible with the profile of the prong of the adjustment tool. With the prong of the tool 16 inserted into the bolt head 35, the user turns the handle of the tool 16 to rotate the adjustment bolt, which causes the bracket 22 to rotate and the angle of the seat back 14 to change.

The foregoing has described a presently preferred embodiment of the invention. However, it should be understood that this is just one example of the present invention. Various changes can be made within the scope of the invention. For example, an electric motor can be mounted on the seat to automate reclining the seat back. The present invention can also be used in conjunction with a special trunk support apparatus and/or with a special apparatus that supports the user's pelvis. Such support apparati are disclosed in U.S. Provisional Patent Application Serial No. 60/129,978, which was filed on Apr. 19, 1999 and was entitled "Hinge Mechanism For a Trunk Support Apparatus," and U.S. Provisional Patent Application Serial No. 60/129,978, which was also filed on Apr. 19, 1999 and was entitled "Pelvic Stabilizer Mechanism For a Wheelchair," both of which are incorporated by reference herein, as are the regular patent applications claiming priority from those two provisional applications, filed Apr. 19,2000<application serial numbers not yet assigned>. That is, the advantages of a conveniently adjustable wheelchair seat back can be combined with the advantages of a trunk support mechanism and/or a pelvis support mechanism for a wheelchair that is particularly convenient to use. Consequently, the present invention is not limited by the preferred embodiment.

What is claimed is:

1. A method for adjusting the angle of a wheelchair seat, comprising the steps of:

(a) providing a system for adjusting the angular position of the backrest of a wheelchair seat, the wheelchair seat having a bottom seat portion and a back seat portion, the system comprising:

a hinge having:

a first hinge bracket fixedly mounted to the bottom seat portion and a moving second hinge bracket fixedly mounted to the back seat portion, said first hinge bracket being hingedly connected with said second hinge bracket;

an adjustment bolt having a head with an aperture, said adjustment bolt extending through said first hinge bracket;

a threaded block hingedly mounted on said moving second hinge bracket, said adjustment bolt being engaged with said threaded block; and an adjustment tool comprising a handle and a prong, said prong having a head with a shape that is compatible with said aperture in said adjustment bolt;

(b) inserting the head of the prong of the adjustment tool into the aperture of the adjustment bolt; and (c) rotating the adjustment tool to rotate the adjustment bolt, causing the moving second hinge bracket to rotate and the back seat portion of the wheelchair seat to change angle relative to the bottom seat portion.

2. A method as defined in claim 1, wherein said prong has a hexagonal profile and said head aperture having a hexagonal profile.

3. A method as defined in claim 1, wherein said bolt adjustment has a head and said system further comprising an adjustment nut threadedly mounted to said bolt, in between said bolt head and said first hinge bracket.

4. A method as defined in claim 3, wherein the method further comprises the step of securing the angle of the hinge by tightening said adjustment nut against said first bracket.

5. A method as defined in claim 1, wherein said moving second hinge bracket has left and right side slots, and said threaded block is hingedly mounted to said moving second hinge bracket with a pin, said pin extending from the left to the right slot.

6. A method as defined in claim 1, wherein said system further comprises a seat bracket, said seat bracket being fixedly mounted to said seat bottom, and said first hinge bracket being mounted to said seat bracket, thereby fixedly mounting said first hinge bracket to said seat bottom.

7. A system which adjusts the angular position of the backrest of a wheelchair seat, the wheelchair seat having a bottom seat portion and a back seat portion, the system comprising:

a hinge having:

a first hinge bracket fixedly mounted to the bottom seat portion and a moving second hinge bracket fixedly mounted to the back seat portion, said first hinge bracket being hingedly connected with said second hinge bracket;

an adjustment bolt having a head with an aperture, said adjustment bolt extending through said first hinge bracket;

a threaded block hingedly mounted on said moving second hinge bracket, said adjustment bolt being engaged with said threaded block; and a tool comprising a handle and a prong, said prong having a head with a shape that is compatible with said aperture in said adjustment bolt.

8. A system for adjusting the angular position of the backrest of a wheelchair seat as defined in claim 7, wherein said prong has a hexagonal profile and said head aperture having a hexagonal profile.

9. A system for adjusting the angular position of the backrest of a wheelchair seat as defined in claim 7 wherein said adjustment bolt has a head and said system further comprising an adjustment nut threadedly mounted to said bolt, in between said bolt head and said first hinge bracket.

10. A system for adjusting the angular position of the backrest of a wheelchair seat as defined in claim 7 wherein said moving second hinge bracket has left and right side slots, and said threaded block being hingedly mounted to said moving second hinge bracket with a pin, said pin extending from the left to the right slot.

11. A system for adjusting the angular position of the backrest of a wheelchair seat as defined in claim 7, said system further comprising a seat bracket that is fixedly mounted to said seat bottom, and said first hinge bracket being mounted to said seat bracket, thereby fixedly mounting said first hinge bracket to said seat bottom.

* * * * *